United States Patent [19]

Moynihan

[11] Patent Number: 4,947,184

[45] Date of Patent: Aug. 7, 1990

[54] ELIMINATION OF NUCLEATION SITES IN PRESSURE CHAMBER FOR INK JET SYSTEMS

[75] Inventor: Edward R. Moynihan, Plainfield, N.H.

[73] Assignee: Spectra, Inc., Hanovar, N.H.

[21] Appl. No.: 364,806

[22] Filed: Jun. 9, 1989

Related U.S. Application Data

[63] Continuation-in-part of Ser. No. 158,656, Feb. 22, 1988, abandoned.

[51] Int. Cl.[5] ..... B41J 2/17; B41J 2/045

[52] U.S. Cl. ..... 346/1.1; 346/140 R; 427/237; 427/255.6

[58] Field of Search ..... 346/140, 1.1; 427/237, 427/255.6

[56] References Cited

U.S. PATENT DOCUMENTS

| | | | |
|---|---|---|---|
| 4,173,664 | 11/1979 | Cieloszyk | 427/255.6 X |
| 4,296,421 | 10/1981 | Hara | 346/140 |
| 4,385,304 | 5/1983 | Sniderman | 346/140 |
| 4,518,623 | 5/1985 | Riley | 427/255.6 X |
| 4,589,000 | 5/1986 | Koto | 346/140 |
| 4,605,939 | 8/1986 | Hubbard | 346/140 |
| 4,725,862 | 2/1988 | Matsuzaki | 346/140 |

*Primary Examiner*—Joseph W. Hartary

*Attorney, Agent, or Firm*—Brumbaugh, Graves, Donohue & Raymond

[57] ABSTRACT

In the particular embodiments of the invention described in the specification, the pressure chamber for an ink jet system is coated with a smooth, conforming layer of a coating material, such as a xylylene polymer material, which is wettable by the ink used with the system to eliminate nucleation sites in the surfaces forming the walls of the chamber and thereby inhibit formation of bubbles from dissolved air contained in ink within the chamber when the ink is subjected to reduced pressure during operation of the ink jet system.

12 Claims, 1 Drawing Sheet

ELIMINATION OF NUCLEATION SITES IN PRESSURE CHAMBER FOR INK JET SYSTEMS

This application is a continuation-in-part of my copending application, Ser. No. 07/158,656, filed Feb. 22, 1988 now abandoned.

BACKGROUND OF THE INVENTION

This invention relates to ink jet systems utilizing pressure chambers and, more particularly, to a new and improved ink jet system having a pressure chamber arranged to inhibit formation of air bubbles therein.

In many ink jet systems, ink is supplied through a supply duct to a pressure chamber which communicates with an outlet orifice, and ink is ejected periodically from the orifice by a rapid contraction of the volume of the compression chamber as a result of action by an electromechanical transducer, such as a piezoelectric element. The rapid contraction is preceded or followed by a correspondingly rapid expansion of the chamber volume. During the expansion portion of the ink drop ejection cycle, the pressure of the ink in the pressure chamber is reduced significantly, increasing the tendency of any air dissolved in the ink within the chamber to form bubbles on the surface of the chamber. Bubbles tend to form in that manner especially at nucleation sites in the chamber such as sharp corners, minute cracks or pits, or foreign particles deposited on the chamber surface, where gases can be retained. Because the presence of gas bubbles within the pressure chamber prevents application of pressure to the ink in the desired manner to eject an ink drop of selected volume from the orifice at a selected time, it is important to avoid the formation of such bubbles in the pressure chamber of an ink jet system.

The Hara et al. U.S. Pat. No. 4,296,421 discloses an ink jet system using water-based or oil-based ink in which the pressure chamber and the discharge orifice are subjected to a treatment to make them water-repellent or oil-repellent so that they are not wetted by the ink used in the system, thereby making it possible to reduce the energy required to eject ink drops from the ink jet head. For this purpose, the orifice plate or the ink jet head is sprayed with a dispersion of Teflon or immersed in a toluene solution of a resin, such as silicone, epoxide, polyurethane, xylylene or the like which is not wetted by the ink used with the system.

The patent to Matsuzaki, U.S. Pat. No. 4,725,867, discloses a process for treating synthetic resin materials forming the ink passageways in an ink jet system to make them wettable by the ink used in the system so as to inhibit bubble formation. Since the treatment described in this patent does not change the surface of the materials, it does not eliminate nucleation sites, such as sharp corners, cracks, pits or foreign particles on the surface.

SUMMARY OF THE INVENTION

Accordingly, it is an object of the present invention to provide a new and improved ink jet system having a pressure chamber arranged to inhibit the formation of air bubbles.

Another object of the invention is to provide a method for producing a pressure chamber for an ink jet system which is effective to inhibit the formation of air bubbles during ink jet operation.

These and other objects of the invention are attained by providing an ink jet system having a pressure chamber connected to an ink jet orifice and communicating with an ink supply duct in which the surface of the pressure chamber is coated with a layer of material providing a smooth, continuous surface conforming to the configuration of the chamber walls which is wettable by the ink used in the system. Preferably, the coating material is an organic substance which can be introduced conveniently into the chamber of an assembled ink jet system and form a conforming coating on the chamber walls which has a low affinity for dirt or solid particulate material that may be contained in the ink used in the system. To assure wetting by the ink used in the system, the coating should have a surface energy higher than that of the ink. For conventional hot melt inks, which have a surface energy of no more than 32 dynes per cm., the appropriate coating materials include many polymeric materials, such as polystyrene, polyvinyl alcohol, epoxies and the like, and especially preferred coating materials are xylylene polymer materials.

BRIEF DESCRIPTION OF THE DRAWINGS

Further objects and advantages of the invention will be apparent from a reading of the following description in conjunction with the accompanying drawings in which.

DESCRIPTION OF PREFERRED EMBODIMENTS

Figure 1:
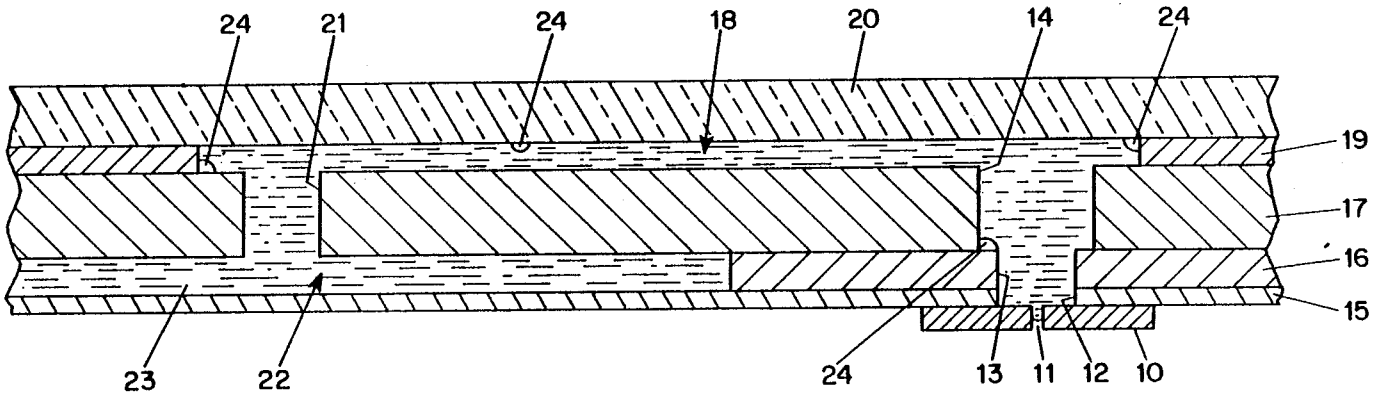
FIG. 1 (PRIOR ART)
FIG. 1 is a schematic fragmentary view in longitudinal section illustrating the arrangement of a pressure chamber and its connections to an ink jet orifice and a supply duct in a typical conventional ink jet system.

In the schematic representation of a typical conventional ink jet system shown in FIG. 1, an ink jet head is conveniently assembled from a series of plate-like elements arranged in sandwich form to produce a composite structure. Thus, an orifice plate 10 has an ink jet orifice 11 which communicates through aligned apertures 12, 13 and 14, respectively, in a membrane plate 15, a cavity plate 16 and a stiffener plate 17 leading to a pressure chamber 18 formed by an opening in a pressure chamber plate 19. The thickness of the pressure chamber plate 19 may be about 3 mils, for example, and the pressure chamber 18 may be about 40 mils wide and about 375 mils long. One side wall of the pressure chamber 18 is provided by the stiffener plate 17 and the opposite side wall is provided by a piezoelectric transducer 20 which moves toward or away from the plate 17 in response to electrical signals as described, for example, in the Fischbeck et al. U.S. Pat. No. 4,584,590. The orifice plate 10 and the plates 15, 16 and 17 may have thicknesses of from about 1 to 10 mils each, and the apertures 12, 13 and 14 may be, for example, about 5 to 10 mils in diameter.

At the other end of the pressure chamber 18, the stiffener plate 17 has an aperture 21 which may be, for example, about 5 to 10 mils in diameter, leading to a cavity 22 in the cavity plate 16 which is connected to an ink supply duct (not shown). When the ink jet system is in operation, ink 23 fills the cavity 22, the aperture 21, the pressure chamber 18, the apertures 12, 13 and 14, and part of the orifice 11 in the orifice plate 10 where a meniscus is formed which normally resists any flow of ink out of the orifice. At the meniscus, however, the ink in contact with the atmosphere absorbs air and dissolved air will be distributed through the ink in the apertures 12, 13 and 14 and into the ink in the pressure chamber 18.

Thereafter, when the wall of the pressure chamber 18 formed by the piezoelectric transducer 20 moves away from the stiffener plate 17, expanding the pressure chamber to draw in ink from the cavity 22, the resulting reduction of pressure on the ink in the chamber 18 tends to produce cavitation as a result of the dissolved air, which can cause air bubbles 24 to form at nucleation sites within the chamber. Such nucleation sites may be provided by sharp discontinuities, such as cracks, pits or corners formed at the line of contact between adjacent plates, they may also be provided by particulate or other contamination deposited on the walls of the pressure chamber. Because of the presence of such nucleation sites in conventional pressure chambers, there will be a tendency for bubbles to form in the pressure chamber whenever air dissolved in the ink is subjected to reduced pressure during operation of the ink jet system.

Figure 2:
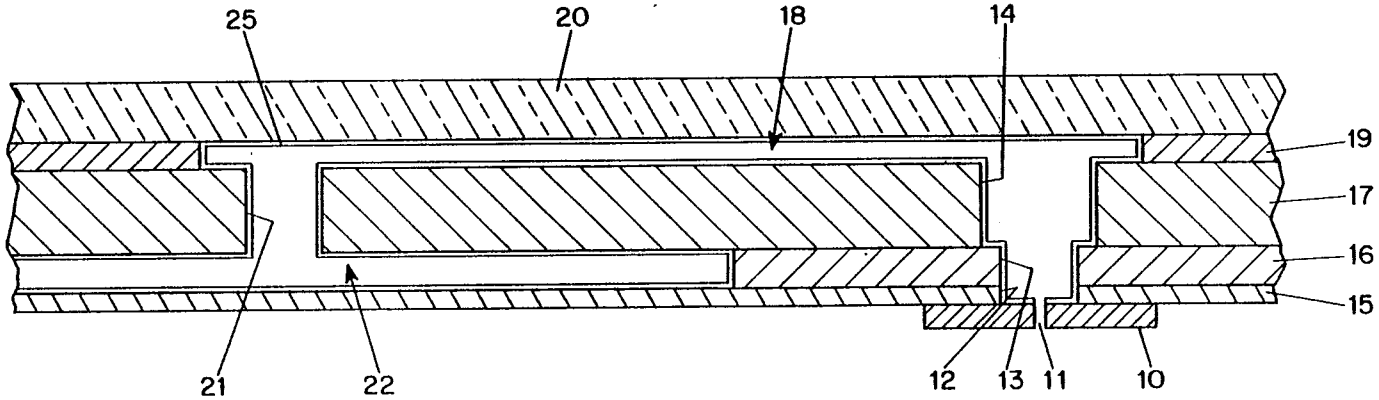
FIG. 2 is a view similar to that of FIG. 1, illustrating a representative pressure chamber for an ink jet system arranged in accordance with the invention.

In accordance with the present invention, the tendency during operation of the system is substantially eliminated by providing a coating on the surface of the pressure chamber of chamber, but fills up or smooths out microscopic discontinuities, such as pits, cracks and sharp corners, in the surface of the pressure chamber walls. A typical arrangement according to the invention is shown in FIG. 2 wherein a thin, continuous coating 25 covers the walls of the chamber 18 and extends into the apertures 12, 13, 14 and 21 as well as the cavity 22. Thus, nucleation sites in the pressure chamber and adjacent regions are eliminated.

To be effective for this purpose, the coating material should provide a pinhole-free, mechanically flexible coating having a clean surface which is wettable by the ink used in the system, i.e., having a surface energy higher than that of the ink. Any conventional type of ink, such as water-based ink, oil-based ink or hot melt ink, may be used in the pressure chamber of the invention. If the ink normally has a higher surface energy than that of the coating, it can be reduced to a level below that of the coating by the addition of a conventional surfactant. Preferably, the surface of the coating should also be nonconductive electrically.

Also, to assure a smooth, continuous surface on the interior of the pressure chamber which is free of microscopic discontinuities, the surface coating should preferably be applied after the pressure chamber and its related connections to the ink jet orifice and the ink supply duct have been assembled. Otherwise, discontinuities may appear, for example, between the coatings on the surfaces of the separate plates which are assembled to form the pressure chamber and related ink ducts. Thus, the material from which the coating is made should preferably comprise a fluid such as a liquid which may be passed through the ducts and apertures into the pressure chamber to leave a thin, uniform coating on the surfaces, or a material which can be passed through the system in vapor or suspended particulate form to condense or deposit on the surfaces and coagulate or coalesce into a uniform, smooth coating.

To provide the necessary electrical, mechanical and surface properties, polymer coating materials such as epoxy, urethane and similar materials are preferred. Especially preferred are the xylylene polymer materials, such as poly(p-xylylene) and poly(chloro-p-xylylene) which can be produced by vaporizing the dimer form to form a vapor which polymerizes upon condensation to form a uniform conforming thin-film polymer coating having the desired electrical, mechanical and surface properties. Since thin layers or films of xylylene polymers can be deposited from the vapor phase in a nondirectional manner, the pressure chamber in an ink jet system can be provided with a uniform thin conforming coating of such polymer materials after assembly of the ink jet head by exposing the ink jet system to the vapor phase of the xylylene material.

Polyxylylene coatings have a surface energy of at least 33 dynes per cm. Other polymeric materials suitable for use with conventional hot melt inks or other inks having a surface energy less than that of the coating material include polystyrene (33 dynes per cm.), polyvinyl alcohol (37 dynes per cm.), epoxy polymers (about 38 dynes per cm.), polymethyl methacrylate and polyvinyl chloride (39 dynes per cm.), polyvinylidene chloride (40 dynes per cm.), polyethylene terephthalate (43 dynes per cm.) and polyimides such as polyhexamethylene adipamide which have surface energies of at least 46 dynes per cm. Inks having a higher surface energy than the coating material, such as certain water-based inks which may have a surface energy as high as 70 dynes per cm., can be used if a surfactant is added to reduce the surface energy of the ink to a level below that of the coating material. Alternatively, the coating for the pressure chamber may be made of a material having a higher surface energy to permit such inks to be used in the system.

To provide a thin, conforming xylylene polymer coating 25 on the walls of a pressure chamber such as the chamber 18 shown in FIG. 2, the ink jet head assembly consisting of the plates 15, 16, 17, 19 and 20, preferably with the orifice plate 10 removed, is subjected to a reduced pressure such as about 0.1 torr. The dimer form of the desired xylylene material, such as dichloro-di-p-xylylene, which is available commercially under the name Parylene D, is vaporized at about 250° C. at a pressure of 1 torr and heated to about 600° C. at 0.1 torr to produce the monomer form which is then applied to an ink jet head assembly maintained at about 25° C. On contact with the surfaces of the ink jet assembly, the monomer condenses and polymerizes to form a continuous thin conforming coating on the surfaces. For other polymer coating materials which do not vaporize and condense in the same manner, any appropriate conventional application procedure such as spraying or dipping may be used.

If the surface of the pressure chamber is not required to be insulating, any suitable metallic coating material may be used. Clean metals typically have a surface energy in the range of about 400 to 2000 dynes per cm. Metallic coatings may be applied in any conventional manner such as by vaporization of the metal and solidification into a continuous layer on the pressure chamber surfaces. Preferably, the conforming coating on the surfaces forming the pressure chamber should be from about 0.1 to about 5 microns thick and, most preferably, between about 0.2 and about 2 microns thick. Since poly(chloro-p-xylylene) is normally deposited from vapor at a rate of about 0.5 microns per minute at room temperature, a 2-micron-thick layer 25 can be coated on the walls of the pressure chamber 18 in about 4 minutes. Poly(p-xylylene) layers form more slowly and may require considerably more time to attain the same thickness under the same conditions.

With a smooth, continuous, conforming layer of the type described herein coated on the walls of a pressure chamber which is wettable by the ink used in the system, nucleation sites which lead to formation of bubbles when ink containing dissolved air is subjected to reduced pressure are substantially eliminated. As a result, ink containing some dissolved air can be subjected to greater pressure reduction without causing bubble formation in the pressure chamber, or ink containing an increased amount of dissolved air can be subjected to the same pressure reduction which would otherwise produce bubbles in the pressure chamber. Consequently, the improved pressure chamber for an ink jet system according to the present invention which effectively inhibits formation of air bubbles overcomes disadvantages of present ink jet systems and permits operation of ink jet systems over a wider range of conditions.

Although the invention has been described herein with reference to specific embodiments, many modifications and variations therein will readily occur to those skilled in the art. Accordingly, all such variations and modifications are included within the intended scope of the invention.

I claim:

1. A pressure chamber for an ink jet system comprising a chamber formed by a plurality of wall segments, a supply of ink in the chamber having a selected surface energy, first aperture means extending through a wall segment and communicating with an ink jet orifice, second aperture means extending through a wall segment and communicating with an ink supply duct, and a layer of xylylene polymer coating material forming a smooth, continuous, impermeable coating conforming to the configuration of the wall segments of the chamber, the coating being mechanically wettable by the ink, thereby eliminating nucleation sites for bubble formation when ink containing dissolved air within the chamber is subjected to a reduced pressure.

2. A pressure chamber according to claim 1 wherein the coating on the wall segments is between about 0.1 and about 5 microns thick.

3. A pressure chamber according to claim 2 wherein the coating on the wall segments is between about 0.2 and about 2 microns thick.

4. A pressure chamber according to claim 1 wherein the coating comprises a polymer material.

5. A pressure chamber according to claim 1 wherein the coating comprises a material having a surface energy of at least about 33 dynes per cm. and the surface energy of the ink is less than about 33 dynes per cm.

6. A pressure chamber according to claim 1 wherein the coating comprises poly(p-xylylene).

7. A pressure chamber according to claim 1 wherein the coating comprises poly(chloro-p-xylylene).

8. A method for preparing a pressure chamber for an ink jet system for use with ink having a selected surface energy comprising forming a chamber having a plurality of wall surfaces and having a first aperture for communication with an ink jet orifice and a second aperture for communication with an ink supply duct, and introducing a xylylene coating material into the chamber so as to deposit a smooth, continuous coating of the material conforming to the wall surfaces of the chamber, the coating being mechanically wettable by the ink used with the system.

9. A method according to claim 8 including the step of vaporizing a xylylene material and introducing the xylylene vapor into the pressure chamber and depositing a coating comprising xylylene polymer material on the wall surfaces of the pressure chamber.

10. A method according to claim 9 wherein the coating deposited on the chamber wall surfaces comprises poly(chloro-p-xylylene).

11. A method according to claim 9 wherein the coating deposited on the chamber wall surfaces comprises poly(p-xylylene).

12. A method according to claim 8 wherein the coating has a surface energy of at least about 33 dynes per cm. and the ink to be used with the system has a surface energy of less than about 33 dynes per cm.

* * * * *

UNITED STATES PATENT AND TRADEMARK OFFICE

CERTIFICATE OF CORRECTION

PATENT NO. : 4,947,184

DATED : August 7, 1990

INVENTOR(S) : Edward R. Moynihan

It is certified that error appears in the above-identified patent and that said Letters Patent is hereby corrected as shown below:

Title page, Item 73: The name "Hanovar" should read --Hanover--.

Column 3, line 24: Before "during" insert --of dissolved air to form bubbles in the pressure chamber--; line 26: After "of" insert --a material which conforms to the surface configuration of the--.

Signed and Sealed this

Fourth Day of February, 1992

*Attest:*

HARRY F. MANBECK, JR.

*Attesting Officer*

*Commissioner of Patents and Trademarks*

US004947184C1

(12) EX PARTE REEXAMINATION CERTIFICATE (6584th)

United States Patent
Moynihan

(10) Number: US 4,947,184 C1
(45) Certificate Issued: Dec. 30, 2008

(54) ELIMINATION OF NUCLEATION SITES IN PRESSURE CHAMBER FOR INK JET SYSTEMS

(75) Inventor: Edward R. Moynihan, Plainfield, NH (US)

(73) Assignee: Spectra, Inc., Lebanon, NH (US)

Reexamination Request:
No. 90/007,129, Jul. 21, 2004

Reexamination Certificate for:

| | |
|---|---|
| Patent No.: | **4,947,184** |
| Issued: | **Aug. 7, 1990** |
| Appl. No.: | **07/364,806** |
| Filed: | **Jun. 9, 1989** |

Certificate of Correction issued Feb. 4, 1992.

Related U.S. Application Data

(63) Continuation-in-part of application No. 07/158,656, filed on Feb. 22, 1988, now abandoned.

(51) Int. Cl.
*B41J 02/16* (2006.01)

(52) U.S. Cl. ..... 347/45; 347/84; 347/92; 427/237; 427/255.6

(58) Field of Classification Search ..... 347/45, 347/47, 44, 65, 84, 92, 46; 427/237
See application file for complete search history.

(56) References Cited

U.S. PATENT DOCUMENTS

| | | | | |
|---|---|---|---|---|
| 4,225,647 | A | 9/1980 | Parent | 428/336 |
| 4,296,421 | A | 10/1981 | Hara et al. | |
| 4,376,945 | A | 3/1983 | Hara et al. | |
| 4,392,907 | A | 7/1983 | Shirato et al. | 156/252 |
| 4,584,590 | A | 4/1986 | Fitschbeck | |
| 4,707,705 | A | 11/1987 | Hara et al. | |

FOREIGN PATENT DOCUMENTS

| | | |
|---|---|---|
| JP | 55-06743 | 5/1980 |
| JP | 60-048363 | 3/1985 |
| JP | 61-137750 | 6/1986 |
| JP | S62-70053 | 3/1987 |

*Primary Examiner*—Manish S Shah

(57) ABSTRACT

In the particular embodiments of the invention described in the specification, the pressure chamber for an ink jet system is coated with a smooth, conforming layer of a coating material, such as a xylylene polymer material, which is wettable by the ink used with the system to eliminate nucleation sites in the surfaces forming the walls of the chamber and thereby inhibit formation of bubbles from dissolved air contained in ink within the chamber when the ink is subjected to reduced pressure during operation of the ink jet system.

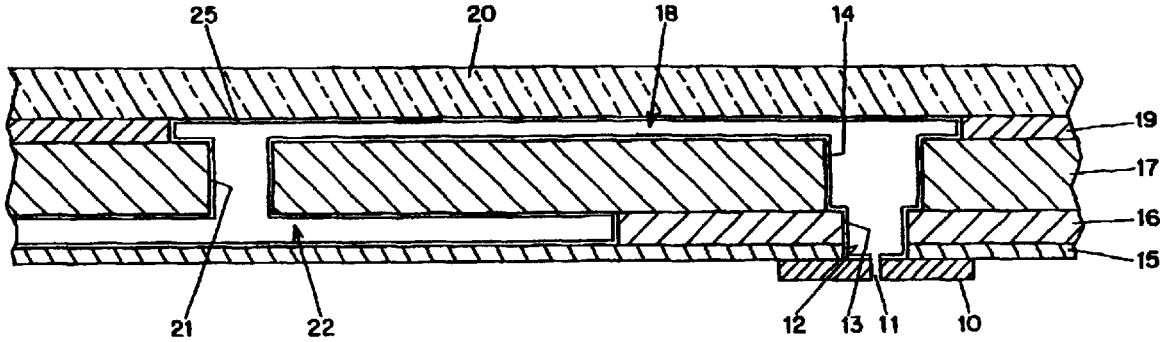

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–12 is confirmed.

New claims 13 and 14 are added and determined to be patentable.

*13. The pressure chamber of claim 1 including a piezoelectric actuator and said xylylene coating material forms a coating on the actuator.*

*14. The method of claim 8 wherein the pressure chamber includes a piezoelectric actuator and depositing a coating of xylylene material on the actuator.*

* * * * *